US006324738B1

(12) United States Patent
Fleissner

(10) Patent No.: US 6,324,738 B1
(45) Date of Patent: Dec. 4, 2001

(54) DEVICE FOR PRODUCING PERFORATED NONWOVENS BY HYDRODYNAMIC NEEDLING

(75) Inventor: Gerold Fleissner, Zug (CH)

(73) Assignee: Fleissner GmbH & Co., Maschinenfabrik, Egelsbach (DE)

( * ) Notice: Subject to any disclaimer, the term of this patent is extended or adjusted under 35 U.S.C. 154(b) by 0 days.

(21) Appl. No.: 09/441,229

(22) Filed: Nov. 16, 1999

(30) Foreign Application Priority Data

Nov. 16, 1998 (DE) ..... 198 52 717

(51) Int. Cl.[7] ..... D06B 5/08
(52) U.S. Cl. ..... 28/104; 28/106
(58) Field of Search ..... 28/104, 105, 106, 28/167, 163; 68/200, 201, 204, 205 R; 492/30, 37

(56) References Cited

U.S. PATENT DOCUMENTS 3,330,009 * 7/1967 Hynek ..... 19/161
3,617,417 * 11/1971 Olsen ..... 156/181
3,681,184 * 8/1972 Kalwaites ..... 161/109
3,837,046 * 9/1974 Kalwaites ..... 28/105
5,098,764 * 3/1992 Drelich et al. ..... 28/104
5,238,644 * 8/1993 Boulanger et al. ..... 28/104
5,274,893 * 1/1994 Kitamura et al. ..... 28/105
5,301,401 * 4/1994 Suzuki et al. ..... 28/104
5,414,914 * 5/1995 Suzuki et al. ..... 28/105
5,632,072 * 5/1997 Simon et al. ..... 28/167
5,727,292 * 3/1998 Vuillaume ..... 28/104
5,759,929 * 6/1998 Ikezawa et al. ..... 28/104
5,768,756 * 6/1998 Noelle ..... 28/104

* cited by examiner

*Primary Examiner*—Amy B. Vanatta
(74) *Attorney, Agent, or Firm*—Antonelli, Terry, Stout & Kraus, LLP

(57) ABSTRACT

A device is known for producing perforated nonwovens by means of hydrodynamic needling, with the perforation consisting primarily of sharply delimited holes in nonwoven of any dimension. The device consists of a smooth drum that supports and transports the nonwoven, said drum being provided with drainage openings to carry away liquid sprayed at high pressure by a nozzle beam from many outlets and having plastic elevations projecting from the plane of the smooth surface for producing the perforations in the nonwoven. The perforated nonwoven that can be produced by this device does not possess uniform strength in all directions. This uniform strength can be achieved simply by distributing the elevations nonuniformly over the drum to produce holes in both dimensions.

24 Claims, 1 Drawing Sheet

DEVICE FOR PRODUCING PERFORATED NONWOVENS BY HYDRODYNAMIC NEEDLING

BACKGROUND 0F THE INVENTION

It is known from U.S. Pat. No. 4,701,237 to confer a perforated structure on a pre-fabricated nonwoven with the unperforated nonwoven being slit several times lengthwise, then stretched laterally to produce the holes, and fixed in this form by heat. A perforated nonwoven of this kind has sharply delimited holes but little lateral strength.

The type of manufacture according to U.S. Pat. No. 3,750,237 is better in this regard, with the prefabricated nonwoven being held between two endless webs and impacted by strong water jets to produce the perforated structure. The desired perforated structure is mounted on the endless web, such as a drum. It consists of a uniformly perforated drum covered all the way around by an endless screen. The endless screen has open and closed areas, depending on the desired hole structure. The disadvantage of this method of producing the holes lies in the fact that no holes with sharply delimited edges can be produced in this fashion and individual nonwoven fibers are pushed toward the endless screen by the strong water jets when the holes are produced and then are caught between the wires of the screen. In addition, the strength of the perforated nonwoven is low since the width of the ribs between the holes is nonuniform. A closer examination of the nonwoven structure reveals disadvantageous interference bands. These are produced by the holes in the drum that have the screen stretched over them and the fixed arrangement of the jets in nozzle beam A.

Sharply delimited holes can be produced subsequently in a prefabricated uniform nonwoven only with the type of manufacture according to EP-A-0 215 648, 0 223 614, or 0 273 454. In each case, a perforated drum is made from a smooth piece of sheet metal with drainage openings, on which drum plastic elevations are provided between the openings and are distributed uniformly over the surface. The plastic elevations can consist of beads that are open halfway, so that drainage openings are also formed at the same time, or of mandrels that taper to a tip at the top and are uniformly distributed, between which the drainage openings in the sheet are arranged in the form of holes. Although this drum can be used to produce the desired holes that are sharply delimited from the nonwoven, the strength of a nonwoven products punched to form circles is not uniform in all directions. The prescribed hole structure or the specified arrangement of plastic elevations in the form of a rhombus or the like prevents this dimensional stability. In addition, the feared interference bands can also appear on the treated nonwoven because the arrangement of the holes in the sheet metal of the drum can interfere with the necessarily permanent arrangement of the nozzle holes in the nozzle beam to form bands.

SUMMARY OF THE INVENTION

The goal of the invention is to provide a device with which all of the conditions of the type mentioned can be met. The holes in the nonwoven not only must be sharply delimited but the perforated nonwoven must possess uniform strength in all directions, not only in the width and perpendicularly thereto, assuming of course that such a uniformly solidified nonwoven was delivered before the hole structure was produced, and shows no interference bands.

Taking its departure from a device according to EP-A-0 215 684, consisting of an endless smooth surface that supports and transports the nonwoven and which is provided with drainage openings to carry away the liquid sprayed at high pressure from many jets in a nozzle beam and also with plastic elevations projecting from the smooth surface to produce the perforations in the nonwoven, the invention consists in the elevations being distributed nonuniformly over the endless surface in both dimensions and in the elevations being distributed with nonuniform spaces between them according to the random principle (use of a random generator) to cover the entire surface supporting the nonwoven. All problems are eliminated with a single stroke. Since the holes are distributed randomly and nonuniformly over the surface of the nonwoven, the highest strength of the perforated nonwoven cannot have a preferred direction. At the same time, no interference bands can any longer appear across the width of the nonwoven, since the water jets emerging from the nozzle beam always strike the elevations at different positions. Thus, the pattern of the perforated nonwoven features nonuniformly distributed holes but the holes cover the entire surface of the nonwoven uniformly and not include any uniform repeating changes such as bands.

In general, the smooth endless surface will be in the form of a drum but it is also possible to use an endless belt to produce the holes. Because of the many drainage openings distributed over the surface of the wall and located close together, because of the production of the plastic elevations as well as the holes in the wall by laser beams for example, the smooth surface in a cross section of the wall can have only a limited thickness. It Is therefore advantageous for lengthwise rails to be provided on the opposite side of the strip or inside the wall of the drum to support the band or drum wall when drawing off the sprayed liquid as required on both sides of the water jets that strike the nonwoven and hence the surface supporting the nonwoven. The suction of the pump can then act between the lengthwise supporting rails.

The plastic elevations, such as mandrels, according to requirements based on practice, should cover the area 20 to 50% and generally 30%. The open surface of the nonwoven is then correspondingly large. The drainage openings which generally consist of drilled or burned holes should then have a diameter of 0.5 to 3 mm, generally 1.5 mm. In this fashion, the sprayed liquid can be carried away faster without the fibers of the nonwoven penetrating the holes and becoming caught there.

The required diameter of the mandrels as well as the distances between them can be calculated as a function of the open area desired by the industry using the equation $$O_A=(D_\varnothing/D_{spacing})^2\times 0.9$$

Here, $O_A$ is the open surface in the nonwoven based on the number of holes or the hole dimensions and structure in the nonwoven, $D_\varnothing$ represents the effective diameter of the hole structure of the plastic elevations (mandrels) and $D_{spacing}$ represents the average spacing of the holes in the nonwoven or of the mandrels on the endless belt or drum. The drainage openings are then made in the wall around the mandrels with the drainage openings being distributed nonuniformly over the surface of the wall, but not according to the random principle like the mandrels but as a function of the locations of the mandrels.

When an endless belt is used as a supporting element for the mandrels, the perforated nonwoven is pulled off at an angle depending on the arrangement of a pull-off device and when a drum is used as a supporting element for the mandrels, the finished nonwoven is pulled off tangentially from the curvature of the drum while the mandrels continued moving in the same circumferential direction. When the nonwoven is separated from the production plane, forces appear at the mandrels that distort the shapes of the holes. To avoid this, the invention provides in one embodiment of the device that the flanks of the plastic elevations such as mandrels, at least as viewed in the transport direction of the nonwoven, that outer flank of the respective plastic elevation, has the form of an involute. Thus the perforated nonwoven separates easily from the mandrels, like gears meshing with one another.

BRIEF DESCRIPTION OF DRAWING

A device of the type according to the invention is shown as an example in the drawing.

DETAILED DESCRIPTION OF THE PREFERRED EMBODIMENTS

Figure 1:
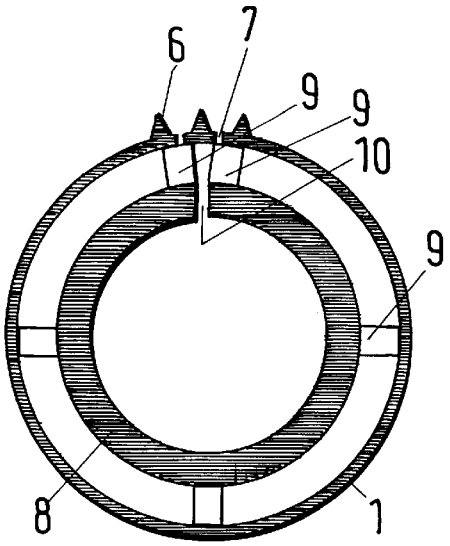
FIG. 1 shows a cross section of a roller to produce perforated nonwoven.

This is a water-needling device like that known for example from DE-A-197 06 610. The device serves to introduce a still non-solidified nonwoven by means of a supporting endless belt into the gap of an endless belt running above and then around the drum, on which the nonwoven is then needled for the first time by jets emerging from the nozzle beam associated with the drum. A device of this kind must be modified to produce sharply delimited holes in nonwovens that have already been solidified or partially solidified. In the drawing, only one drum 1 for this purpose is shown, preceded and followed by additional peripheral parts, omitted here for the sake of clarity.

Figure 2:
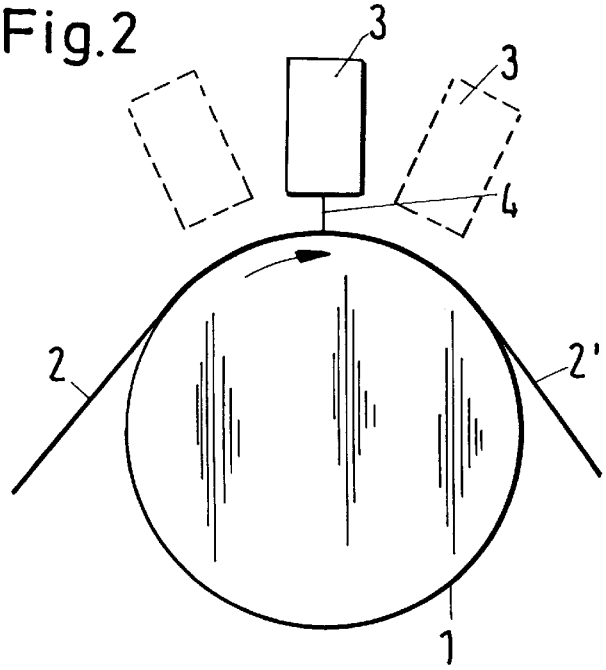
FIG. 2 shows the roller according to FIG. 1 with the nonwoven guided over it and the nozzle beam associated with the roller.

The nonwoven 2, basically finished and not supported by an endless belt, then runs directly over drum 1 with which one or more nozzle beams 3 according to FIG. 2 are also associated directly. Nozzle beam 3 is located axially parallel to drum 1 and is provided on its underside facing drum 1 with a nozzle strip, not shown, to allow water jets 4 to emerge.

Figure 3:
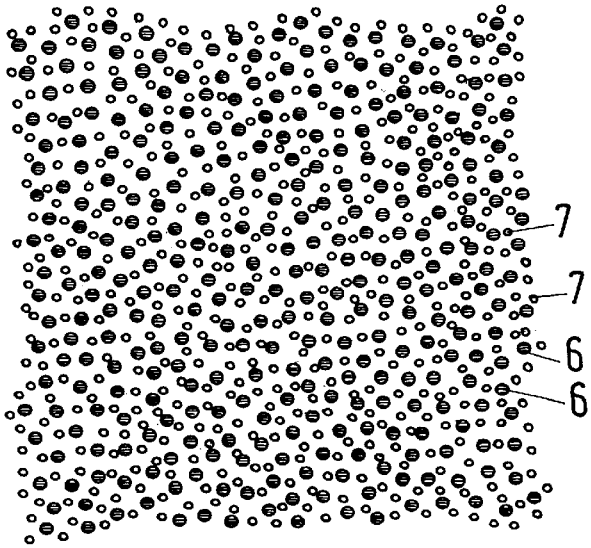
FIG. 3 is a top view of the wall of the drum according to FIGS. 1 and 2 with a plurality of mandrels projecting plastically from the plane of the drum wall that do not correspond to any repeating pattern in a nonuniform distribution.
Figure 4:
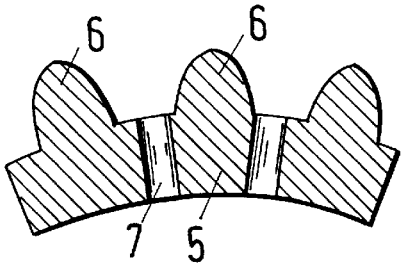
FIG. 4 shows the wall of the drum in the vicinity of a mandrel in an enlarged view and in cross section.

Drum 1 according to FIG. 1 consists of a drum wall 5 which is thin and unstable if made of plastic, but if the drum is made of metal such as brass, drum wall 5 can be stable and self-supporting. This drum wall 5 according to FIG. 4 has a plurality of plastic elevations such as mandrels 6 on the outside which can be arranged according to FIG. 3 in a completely nonuniform distribution over the circumferential surface of the drum. Mandrels 6 are surrounded by drainage openings 7. The arrangement of mandrels 6 is determined by a random generator so that the result is an arrangement that does not repeat. The distance of mandrels 6 from one another therefore changes nonuniformly as shown in FIG. 4. The plurality of mandrels 6 according to this arrangement can be burned out from the solid material in the wall by means of computer-controlled laser beams. Later, or at the same time, the drainage openings such as bores 7 can be produced, which surrounded mandrels 6. The respective distances of bores 7 from the boundaries of mandrels 6 are nonuniform, as indicated in FIG. 4, but the arrangement of holes 7 in wall 5 is dependent on the arrangement of mandrels 6 and thus is determined only secondarily or not all by a random generator. The pattern of holes 7 around mandrels 6 can frequently be the same and can show a periodically repeating pattern; it is important only that the arrangement of mandrels 6 be nonuniform.

The effective diameter of mandrels 6 depends on the open surface of the perforated nonwoven desired by the industry. This open area is determined by the diameters of the individual holes and their numbers/unit areas. Depending on the specification factor, the rest of the sizes can be calculated with the aid of the equation $$O_A=(D_\varnothing/D_{spacing})^2\times 0.9$$

where $O_A$ represents the opening area in nonwoven 2' because of the number of holes or the hole dimension and structure in the nonwoven and $D_\varnothing$ represents the diameter of mandrels 6 and $D_{spacing}$ represents the average spacing of the holes in the nonwoven or of mandrels 6 on drum 1.

In general, the open surface is desired to be 30% and the holes in the nonwoven should be 3 to 5 mm apart, but the number of mandrels 6 per area can be determined and the random generator can be supplied with this information. The drainage openings to carry away the sprayed liquid must then be produced and their diameter should be between 0.5 and 1.5 mm so that the fibers of the nonwoven do not catch in holes 7. However, it is also possible to produce the perforated structure in the nonwoven with mandrels 6 whose dimensions are nonuniform; therefore both deep and shallow holes can be produced in the nonwoven by appropriately dimensioned mandrels 6.

The shape of mandrels 6 can be determined from FIG. 1 as well as FIG. 4; they extend around drum 1. The alignment of the outer surface is conical and converges outward. As shown, however, the cross-sectional shape is not conical, in other words it does not taper uniformly, but the contour at the cross section line has the form of an involute that depends on the diameter of drum 1. In the embodiment, mandrels 6 are bent around like an involute, but it is important to design only the area of mandrels 6 in this fashion that is at the front in the transport direction because in this case the stretching phenomena that result from removing the perforated nonwoven 2' from drum 1 can be especially negative for the desired sharp delimitation of the holes.

Drum wall 5 according to FIG. 1 is supported all the way around on a stronger roller 8 by lengthwise sliding rails 9. Roller 8 is simultaneously the suction tube within which suction is produced to carry away sprayed liquid 4 from nonwoven 2. For this reason, suction slot 10 is delimited radially externally on both sides by such lengthwise sliding rails 9 which can also be mounted on roller 8 to be displaceable in the circumferential direction. The lengthwise sliding rails here serve not only to support drum wall 5 but also to seal suction slot 10. In the case of a plurality of nozzle beams associated with drum 1, a corresponding number of suction slots is also provided. Drum wall 5 can be made of plastic or of metal for improved stability. Lengthwise sliding rails 9 can also be made of both materials but the pairing of the materials must be different so that metal always slides on plastic.

What is claimed is:

1. Device for producing perforated nonwovens by hydrodynamic needling, with perforations being formed of essentially sharply delimited holes in nonwoven of any dimensions, comprising an endless surface that is smooth and supports and transports a nonwoven, said endless surface being provided with drainage openings to carry away liquid sprayed at high pressure from a plurality of jet openings of a nozzle beam and with a plurality of elevations projecting out of the plane of the endless surface to produce the perforations in the nonwoven, wherein the elevations are distributed nonuniformly in both dimensions over the endless surface and the drainage openings are subjected to suction from a side of the endless surface opposite to a side on which the projections are provided.

2. Device according to claim 1, wherein the elevations are randomly distributed at nonuniform intervals so that they cover all of the nonwoven.

3. Device according to claim 1, wherein the endless surface is a top of an endlessly circulating belt.

4. Device according to claim 1, wherein the endless surface is an outer surface of a drum.

5. Device according to claim 1, further comprising a nozzle beam extending over a working width of the nonwoven and having jets uniformly distributed over its length, from which liquid flows against the nonwoven, wherein lengthwise sliding rails are provided to support the endless surface on the side of the endless surface opposite to the side on which the projections are provided.

6. Device according to claim 5, wherein a suction slot of a roller is located between two lengthwise sliding rails and therefore the suction of a pump acts on the nonwoven resting on the endless surface.

7. Device according to claim 6, wherein the lengthwise sliding rails abut an axially parallel suction roller under suction.

8. Device according to claim 7, wherein more than only two lengthwise rails, in addition to the lengthwise sliding rails between which the suction slot is located, are located around suction roller to completely support the endless surface.

9. Device according to claim 1, wherein the endless surface is made of plastic.

10. Device according to claim 1, wherein the endless surface is made of a metallic material.

11. Device according to claim 5, wherein the lengthwise sliding rails are made of plastic or metal.

12. Device according to claim 1, wherein the elevations cover a total of 20 to 50% of the endless surface.

13. Device according to claim 1, wherein the drainage openings between elevations have a diameter of 0.5 to 3 mm.

14. Device according to claim 1, wherein the spaces between the elevations measure 1.5 to 28 mm.

15. Device according to claim 14, wherein the open surface of the nonwoven, or the effective diameter of the elevations for producing the perforated nonwoven structure, is calculated by the following formula:

$$O_A=(D_\varnothing/D_{spacing})^2\times 0.9$$

where $O_A$ represents the open area in the nonwoven on the basis of the number of holes or the hole dimension and structure in the nonwoven, $D_\varnothing$ represents the diameter of the elevations that produce the hole structure, and $D_{spacing}$= represents the average spacing of the holes in the nonwoven or of the elevations on the endless surface.

16. Device according to claim 1, wherein the elevations are formed by ends that taper conically upward or taper to a point.

17. Device according to claim 16, wherein flanks of the elevations, at least as viewed in the transport direction of the nonwoven, have an outer flank in a shape of an involute.

18. Device according to claim 1, wherein a height of the elevations is 1 to 3 mm.

19. Device according to claim 3, wherein the endless surface is cut from a solid material layer by means of an engraving laser beam.

20. Device according to claim 1, wherein a cross-sectional area and/or an effective diameter of the elevations varies.

21. Device according to claim 4, wherein more than one nozzle beam is directed against the endless surface to produce the perforated structure in the nonwoven.

22. Device according to claim 1, wherein the elevations cover a total of 30% of the endless surface.

23. Device according to claim 1, wherein the drainage openings between elevations have a diameter of 1.5 mm.

24. Device according to claim 1, wherein the spaces between the elevations measure 3 to 10 mm.

* * * * *